United States Patent [19]

Wheeler

[11] 4,040,473

[45] Aug. 9, 1977

[54] ANNULAR LENS CLEANER

[75] Inventor: Lewis Halsay Wheeler, Almond, N.Y.

[73] Assignee: The Air Preheater Company, Inc., Wellsville, N.Y.

[21] Appl. No.: 714,164

[22] Filed: Aug. 13, 1976

[51] Int. Cl.[2] ..... F28D 17/00

[52] U.S. Cl. ..... 165/5; 165/11; 250/338

[58] Field of Search ..... 165/5, 11; 250/338, 250/353, 352

[56] References Cited

U.S. PATENT DOCUMENTS

| | | | |
|---|---|---|---|
| 3,662,174 | 5/1972 | McMullen | 250/358 |
| 3,861,458 | 1/1975 | Ostrander et al. | 165/11 X |

*Primary Examiner*—Albert W. Davis, Jr.
*Attorney, Agent, or Firm*—Wayne H. Lang

[57] ABSTRACT

An infrared ray viewing device for an air preheater having a clamping ring that holds a lens in a predetermined position and simultaneously provides an air flow passageway around the periphery of the lens to exhaust a stream of cleaning air radially over the surface of the lens to remove dust deposits therefrom.

3 Claims, 3 Drawing Figures

ANNULAR LENS CLEANER

BACKGROUND OF THE INVENTION

In regenerative air preheaters hot exhaust gases give up their heat to a mass of heat absorbent material that in turn gives up its heat to cool air or other gases flowing therethrough.

Instruments have been developed that are directed at the mass of heat absorbent material to detect the temperature thereof as a prerequisite for detecting incipient fires and initiating fires control within the air preheater. When viewing lenses are included in the temperature detection instruments to focus the rays upon a detector, the viewing lenses frequently become clouded or dirty because of the contaminated, corrosive atmosphere in which they must be immersed. As the viewing lenses become dirty they fail to transmit sufficient light so the detection instruments themselves fail to give a true indication of temperature or other conditions within the preheater.

DESCRIPTION OF PRIOR ART

U.S. Pats. Nos. 3,730,259 of 1973 and 3,861,458 of 1975 disclose apparatus that is positioned in a stream of air facing a heat absorbent matrix to detect the infrared rays being emitted thereby.

In actual use it has been found that positioning an infrared ray detector including a lens therefor in a viewing position inherently subjects the lens to a stream of corrosive gases and entrained particulate matter such that it becomes clouded, fails to quickly detect a change in infrared ray emission, and results in a loss of viewing efficiency. Thus, the effectiveness of viewing device is directly dependent upon maintaining a viewing lens in a clean condition.

SUMMARY OF THE INVENTION

This invention relates to an arrangement by which a viewing lens of a detector of infrared rays is mounted to enable the lens to remain clean throughout a wide variety of environmental situations and thus maintain an optimum sensitivity to a variation in the transmission of infrared rays therethrough. More particularly, the arrangement provides a device that directs a blast of clean air over the lens to remove any collected deposits of dust particles therefrom so as to continuously maintain the lens in a near optimum viewing condition.

DESCRIPTION OF THE PREFERRED EMBODIMENT

Figure 1:
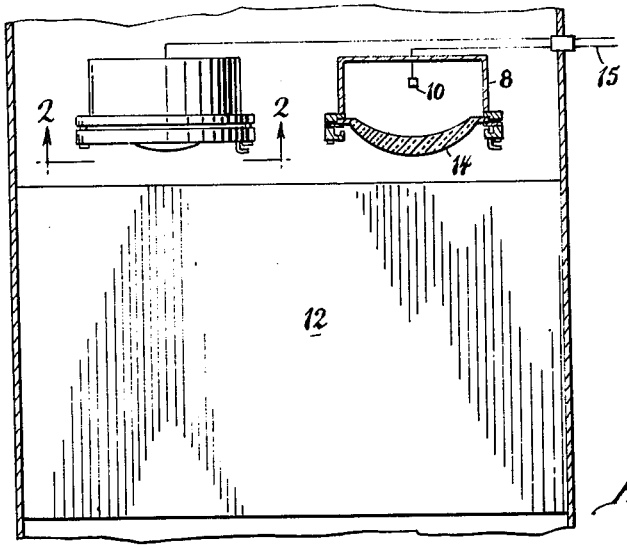
FIG. 1 is a side elevation of a heat exchanger having an infrared ray sensing device adapted to receive infrared rays that are radiated outward from a heat absorbent matrix.
Figure 2:
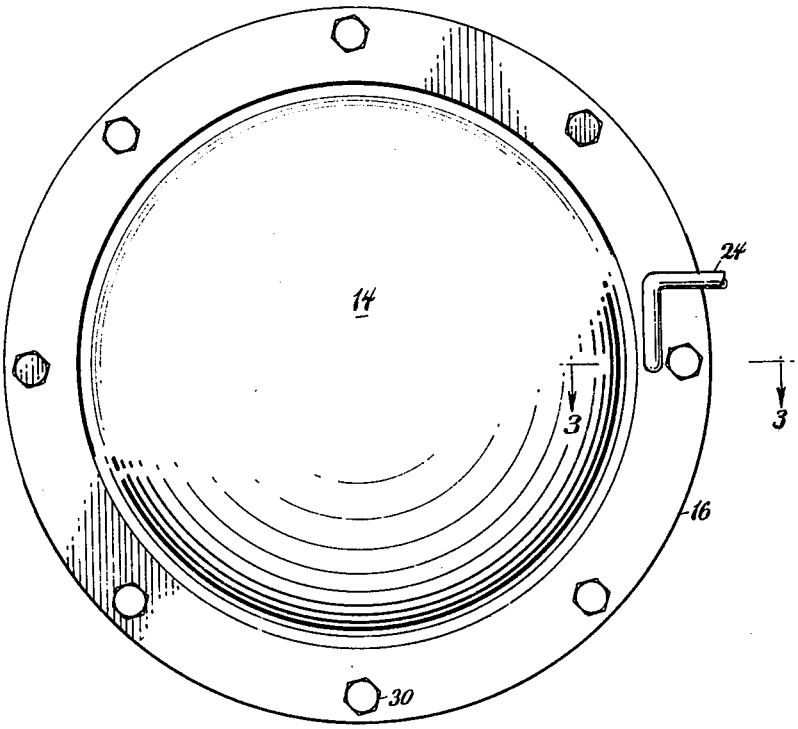
FIG. 2 is a plan view of an individual heat absorbent matrix as seen from line 2—2 if FIG. 1.
Figure 3:
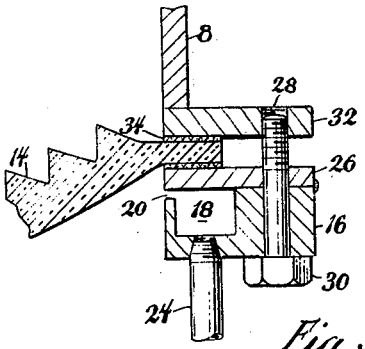
FIG. 3 is a side elevation of the lens holder as seen from line 3—3 of FIG. 2.

In the drawing a sensor head 8 contains an electrical sensing device 10 that is subject to the infrared ray emission of an object such as the matrix 12 of a regenerative air preheater. The sensor head includes a lens 14 that faces the source of infrared rays to focus the rays upon the sensing device 10 where said rays are translated into an electrical signal. The signal is then transmitted over suitable conductors 15 to an indicating device (not shown) which indicates their strength as a function of infrared ray emission.

To maintain the lens at or near its peak of light transmission capability, the lens is periodically subjected to a flow of cleaning air that removes alien deposits therefrom. Inasmuch as a lens for an arrangement as herein disclosed is normally positioned in a flowing gas stream, the center of the lens facing the air stream is scoured substantially clean by natural gas flow or turbulence, while only the edges thereof adjacent the lens mounting device accumulates excess particulate matter. However, when deposits of dust accumulate along the periphery of the lens, the light transmission thereof is quickly reduced.

Accounding to this invention, there is provided an arrangement of a lens holder that comprises an annular base 16 having an annular chamber 18 that terminates along the inner periphery in an annular slot 20 that extends completely around the lens. The chamber is supplied with a quantity of compressed air from a source 24 whereby a blast of air may be exhausted from slot 20 radially over the lens to subject the periphery thereof to a maximum amount and the central part of the lens to a lesser amount of cleaning air, thus complementing the normal scouring of the lens continuously taking place.

The base 16 comprises an annular member that is bonded to the mounting ring 26 as by welding to prevent the leakage of air from within the annular chamber 18. The holding bolts 30 extend through the base ring 16 and the mounting ring 26 to threaded openings 28 in clamping ring 32 whereby the lens 14 may be held tightly between rings 26-30. Suitable annular gaskets 34 of packing material surround the edge of the lens to hold it tightly and prevent the flow of contaminated air into the sensor head 8.

The annular lens holding means 26–32 is formed with an inside diameter somewhat less than the outside diameter of lens 14 whereby only the periphery of the lens will be held tightly thereby. The annular base 16 is preferably formed with a U-shaped cross-section where the inside leg of the "U" is somewhat shorter than the uter leg thereof, said difference providing the elongate slot 20 extending around the lens to exhaust cleaning air from annular chamber 18.

I claim:

1. A heat exchanger having a housing including inlet and outlet ports for a heating fluid and for a fluid to be heated, a heat absorbent matrix in said housing, means for alternately subjecting the matrix to the heating fluid and to the fluid to be heated, a detector of infrared rays being emitted by the matrix, a viewing lens confronting the matrix to focus the rays upon said detector, a source of clean air, an annular base member holding the viewing lens, an annular plenum chamber in said annular base, and an annular slot extending completely around said base member to exhaust clean air over the periphery of said lens.

2. A heat exchanger as defined in claim 1 wherein the annular plenum chamber lies radially outside the annular slot whereby clean air from the source is exhausted radially inward over the viewing lens.

3. A heat exchanger as defined in claim 2 wherein the viewing lens comprises circular Fresnel lens.

* * * * *